US006089370A

United States Patent [19]

Mughal

[11] Patent Number: 6,089,370

[45] Date of Patent: Jul. 18, 2000

[54] METHOD AND SYSTEM FOR PACKING ITEMS

[75] Inventor: Muhammad Zahur Mughal, East Brunswick, N.J.

[73] Assignee: Peak Industries, Inc., Highland Park, N.J.

[21] Appl. No.: 09/253,958

[22] Filed: Feb. 22, 1999

[51] Int. Cl.[7] ..... B65D 85/28

[52] U.S. Cl. ..... 206/372; 206/564; 206/581; 206/505; 220/23.83; 211/70.6

[58] Field of Search ..... 206/562, 349, 206/557, 370, 372, 581, 561, 564, 505, 506, 507, 509, 510, 572, 499, 364, 373; 220/23, 83, 516; 211/70.6

[56] References Cited

U.S. PATENT DOCUMENTS

| | | | |
|---|---|---|---|
| 3,027,045 | 3/1962 | Wilson | 206/503 |
| 4,293,074 | 10/1981 | Dunsky | 206/572 |
| 4,523,679 | 6/1985 | Paikoff et al. | 206/370 |
| 4,595,102 | 6/1986 | Cianci et al. | 206/572 |
| 4,895,256 | 1/1990 | Johnston | 206/501 |
| 5,117,979 | 6/1992 | Brightbill | 206/372 |
| 5,339,955 | 8/1994 | Horan et al. | 206/370 |
| 5,441,152 | 8/1995 | Estes | 206/570 |
| 5,445,263 | 8/1995 | Mohlenkamp et al. | 206/303 |
| 5,465,843 | 11/1995 | Koefelda | 206/507 |
| 5,573,116 | 11/1996 | Zink | 206/378 |
| 5,752,602 | 5/1998 | Ackermann et al. | 206/507 |
| 5,894,971 | 4/1999 | Huang | 224/218 |

*Primary Examiner*—Paul T. Sewell
*Assistant Examiner*—Nhan T. Lam
*Attorney, Agent, or Firm*—Levisohn, Lerner, Berger & Langsam

[57] ABSTRACT

A system and method for storing and packing items are provided. Trays are provided with overlapping recesses conforming in shape at least partially to the perimeter of the items. The items are nested one within another on each tray, and each tray is nestingly engageable with other trays. Nesting thus occurs in at least two dimensions, and packing efficiency is maximized.

16 Claims, 3 Drawing Sheets

10
16
74
14
12-4
70
64
14A
14
72
12-3
54
60
62
12-2
50
18-1
15
52
12-1

METHOD AND SYSTEM FOR PACKING ITEMS

BACKGROUND OF THE INVENTION

1. Field of the Invention

The invention is directed to systems for packing multiple items. More particularly the invention is directed to a system of packing and/or storing multiple items in a way that minimizes volume so as to reduce shipping and packaging costs and facilitate packing and unpacking of the items.

2. Description of Related Art

Manufactured items often need to be shipped in bulk to warehouses, wholesalers, retailers, and other destinations before they are purchased by consumers. It is commonly desired to maximize the spatial packing efficiency of the packed items during bulk shipping so as to minimize the costs associated with shipping; the smaller the volume something occupies, the less expensive it is to ship, and the lower the costs associated with packing materials are. It is often important to protect manufactured items from damage during shipping. When cartons of items are dropped or jarred, the individual items inside can bump into each other and often damage each other.

One conventional way of alleviating some of the above problems is by wrapping the items in flexible sheets of plastic with a great number of air pockets trapped therein, or "bubble wrap". Bubble wrap is commonly wrapped around an item and then tape or a rubber band is fastened around the bubble wrap to secure the bubble wrap to the item.

Bubble wrap can be useful in some applications, however it suffers from a number of drawbacks. First, an item wrapped in bubble wrap occupies a significantly larger volume than does the item by itself; the use of bubble wrap thereby drives the cost of shipping and storing the items up. Second, bubble wrap can be difficult to apply around items, especially if the items are irregularly shaped. Similarly, bubble wrap can be difficult to remove, making the unpacking process time consuming and expensive. Moreover, for small items, it is common that several items will be wrapped in the same piece of bubble wrap; should these items be jarred, they can easily strike against one another thereby damaging each other. Finally, after the items have been unpacked, there is a great deal of high volume waste generated by the removed bubble wrap.

SUMMARY OF THE INVENTION

Accordingly, it is an object of the invention to maximize spatial packing efficiency during bulk shipping.

It is another object of the invention to lower the costs associated with packing materials.

It is another object of the invention to protect manufactured items from damage during shipping.

It is another object of the invention to provide a structure for storing items for shipping that is easy to apply around the items.

It is another object of the invention to provide a structure for storing items for shipping that is easy to remove.

It is another object of the invention to provide a system for storing items for shipping that does not generate a great deal of high volume waste when the items are unpacked.

The above and other objects are achieved by the invention, which includes a system for storing items, preferably hand tools having handles, more preferably hand-held cutting implements the system having a plurality of trays.

The items are nestingly disposable on the trays in a plane, and the trays are themselves nestingly stackable in a direction perpendicular to that plane. Each of the trays is provided with a plurality of recesses, each of the recesses shaped to conform at least partially to a perimeter of the items. The recesses are formed in an overlapping fashion, so that when the items are placed in the recesses, one item will nest at least partially within at least one adjacent item. Put another way, one main recess includes a number of sub-sections or sub-recesses all formed together in an abutting fashion; each sub-recess can accommodate an item nested within an adjacent item. Preferably, the recesses are provided with a raised ridge which receives the distal end of one item when it is nested within the proximal end of a second item. The ridge serves to immobilize the distal end of the first item and protect the first item from striking the second item.

The trays are substantially convex on their upper surfaces and substantially concave portions on their lower surfaces; the convex portion of one tray is nestingly engageable with the concave portion of a second tray. Preferably, the trays are provided with a flared rim formed at least substantially around a perimeter of the tray. The rim extends from the lower surface of the tray in a direction substantially perpendicular to the plane of the tray. The upper surface of a first tray is nestable within the flared rim of a second tray.

The invention also includes a method for storing items. First, the items are arranged on a number of planar storage trays, preferably in a nested configuration. The planar storage trays are then nested one on top of another in a direction perpendicular to a plane of the storage trays. When the items are arranged on the trays, a distal end of one item is preferably nested at least partially within a proximal end of a second item. The inventive method is particularly suited to the storing and shipping of cutting implements, such as cuticle nippers, as the blades of one implement can be nested between the handles of another implement.

The invention is ideal for storage of items during bulk shipping. By providing nesting in at least two dimensions—one dimension on the plane of the tray, and the other dimension perpendicular to the tray—packing efficiency during bulk shipping is maximized, and costs associated with packing materials are lowered. By isolating each individual item from all other items and preventing shifting of the items, the invention protects the items from damage during shipping. Moreover, it is easy to use the inventive storage system, in that it is simple to place the items in the trays and the trays together, and it is easy to separate the trays and then remove the items from the trays. Finally, the inventive storage system reduces the amount and volume of waste generated from shipping; when the items are removed from the trays, the trays may again be nested or stacked for disposal or recycling.

DETAILED DESCRIPTION OF THE PREFERRED EMBODIMENT

Description will now be given of the preferred embodiment of the invention with reference to FIGS. 1–6.

Figure 1:
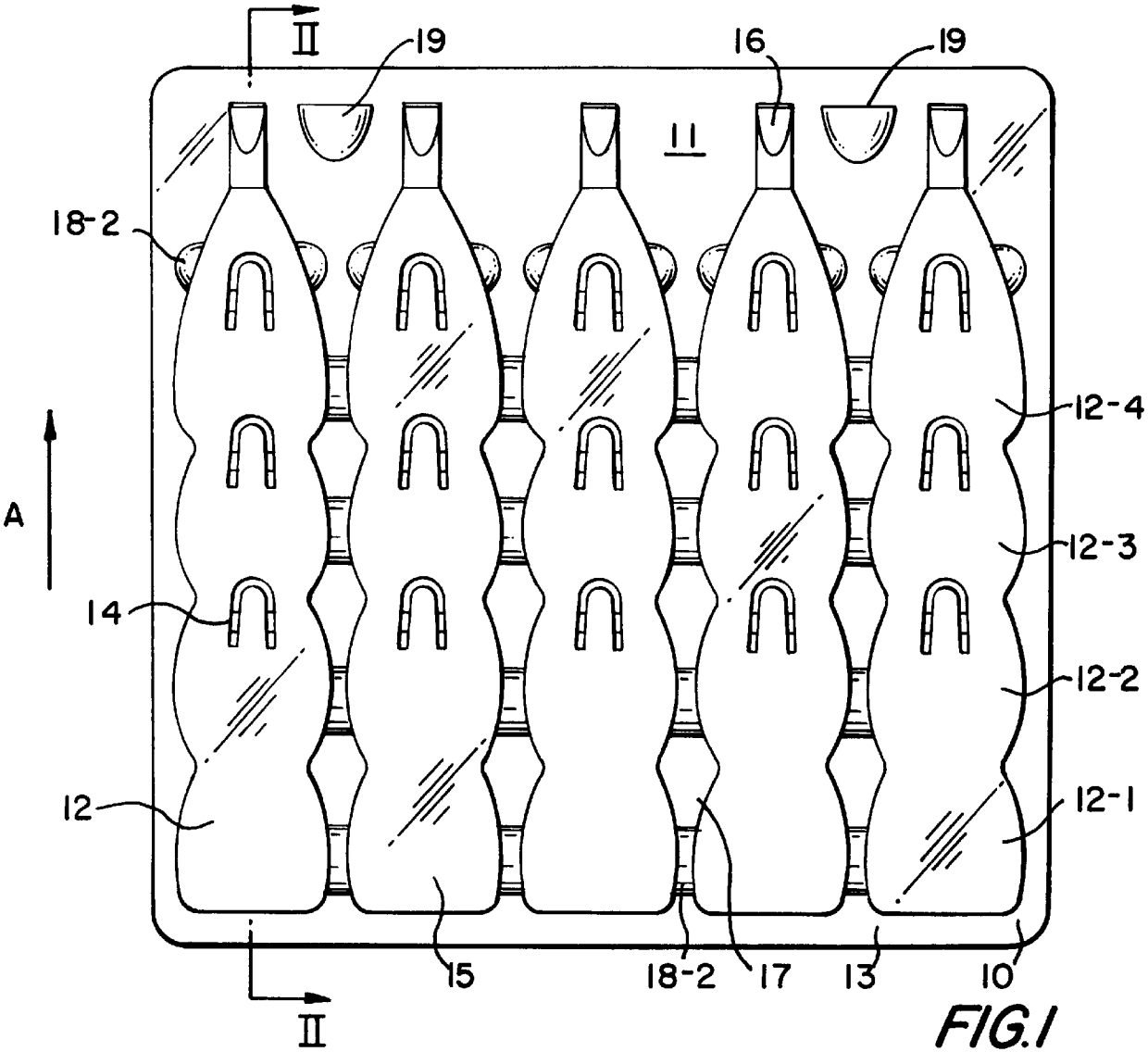
FIG. 1 is a top elevation view of a tray component of the inventive storing system.
Figure 2:
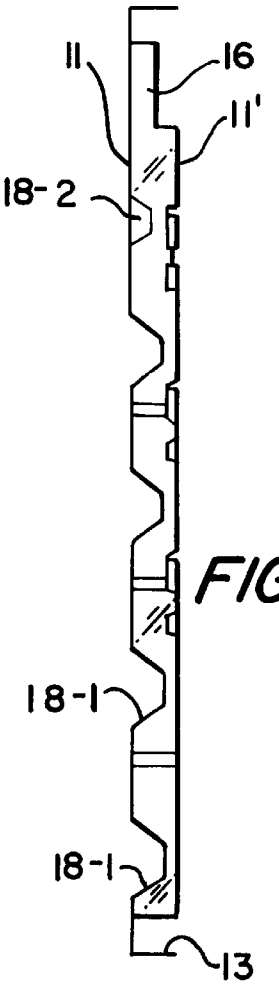
FIG. 2 is a sectional view of the tray component of the inventive storing system taken along line II—II of FIG. 1.

The inventive storing and shipping system includes a number of trays 10 as depicted in FIGS. 1 and 2. Tray 10 is provided with a number of recesses 15 each having sub-recesses or subsections 12. Each sub-section is shaped to conform to the outline or perimeter of the items being shipped or stored. The recesses 15 are arranged next to each other so that they form a two-dimensional array of subsections 12. The sub-sections 12 of a given recess 15 are formed in an abutting fashion, meaning that the distal end of one sub-recess 12 abuts the proximal end of an adjacent sub-recess 12. As shown in FIG. 1, sub-recess 12-1 abuts with recess 12-2 which abuts with recess 12-3 which abuts with recess 12-4.

Figure 3:
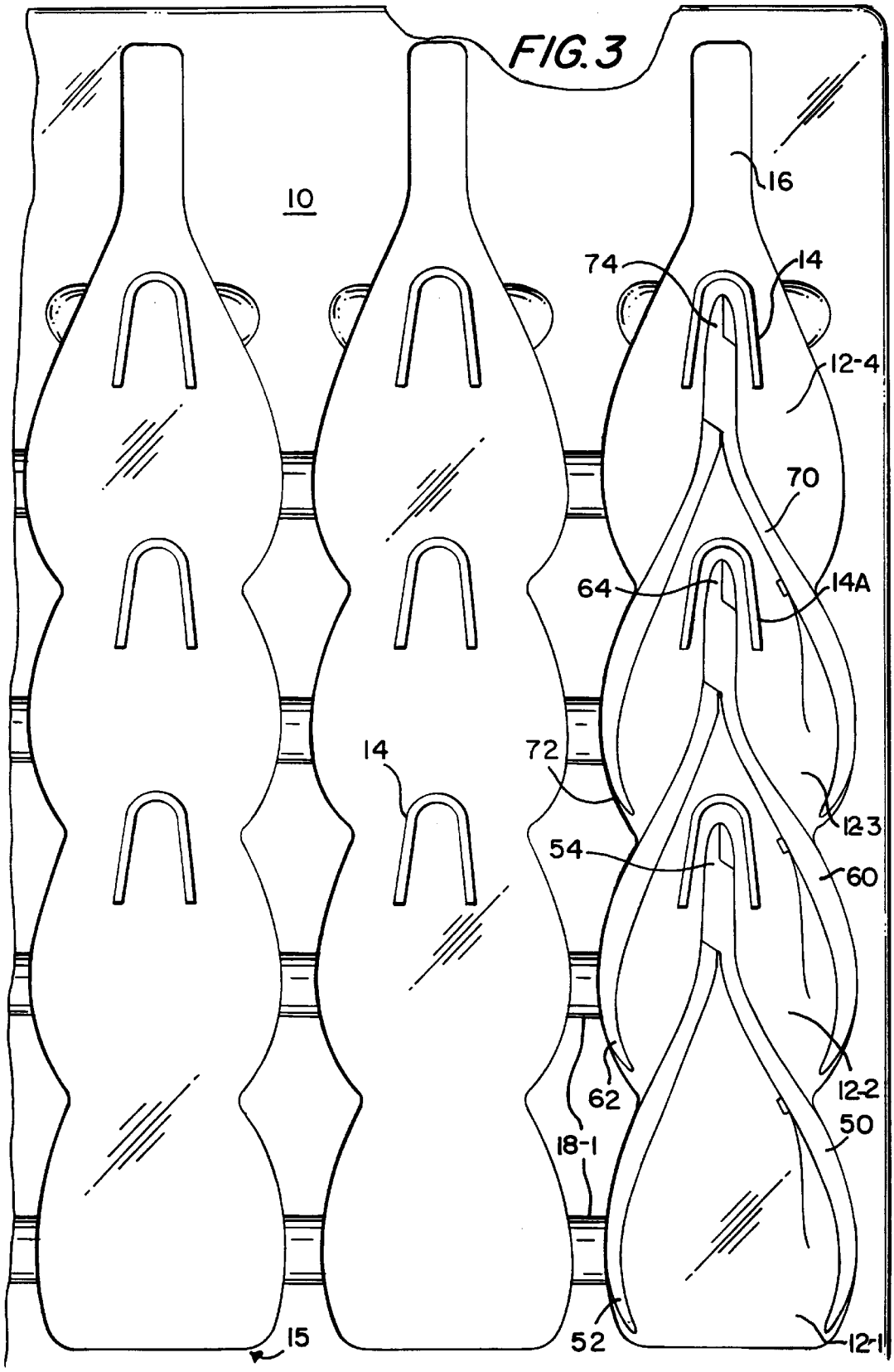
FIG. 3 is a transparent bottom view of the tray component of FIGS. 1 and 2 depicting several items stored therein.

The result of having abutting sub-recesses 12 as shown in FIG. 1 is that, when items are disposed in the sub-recesses 12, they, overlap and are nested within one another, thereby reducing storage and shipping volume, the amount of material needed to wrap the items, the weight of the overall shipped package, and the amount of waste produced when the items are unpacked. This is exemplified in FIG. 3 which shows several items placed in tray 10. In the preferred embodiment, the items to be stored and shipped are cutting implements such as cuticle nippers, for example. However, it should be realized that the invention is not limited to these types of items. At any rate, FIG. 3 shows three cutting implements 50, 60, and 70 placed in sub-recesses 12-1, 12-2, and 12-3 of tray 10 respectively. Each of the cutting implements 50, 60, and 70 has a proximal end 52, 62, and 72, which include the handle portion of the implements, and a distal end 54, 64, and 74 which include the blade ends of the implements. Distal end 54 of implement 50 is nested within proximal end 62 of implement 60, and distal end 64 of implement 60 is nested within proximal end 72 of implement 70.

Disposed in and protruding up from sub-recesses 12 are raised ridges 14. Ridges 14 act as a barrier between two adjacent nested items stored in abutting sub-recesses 12. For example, in FIG. 3, ridge 14A is formed in sub-recess 12-2 and surrounds and protects distal end 64 of implement 60. Ridge 14A also abuts against one of the handles of implement 70 and helps keep implement 70 immobilized in sub-recess 12-3. Ridges 14 each serves to immobilize both the proximal end of one item and the distal end of an adjacent nested item to protect the cutting edges of the items from damage. Ridges 14 also prevent two adjacent items from striking each other during shipping and thus prevent breakage, scratching, or other damage to either item. The uppermost row of sub-recesses 12 (i.e., the top or front portion of each recess 15) is not provided with ridges; instead each sub-recess 12 in the uppermost row on tray 10 has a raised platform 16 for securing the distal end of items places therein. As best illustrated in FIG. 2, platforms 16 rise above the level of recesses 12 on the upper surface 11 and are less convex than sub-recesses 12 on the lower surface 11'.

Separating adjacent recesses 15 of are raised dividers 17. Raised dividers 17 are convex on an upper surface 11 of tray 10 and are concave on the lower surface 11' of tray 10. That is, tray 10 is preferably a thin single sheet, more preferably of plastic. Notches 18-1 are formed in dividers 17 to allow a person easier finger access on items disposed in the sub-recesses 12. Notches 18-2 are provided for the same reason on the topmost row of recesses. Notches 18-1 and 18-2 also provide for additional concave portions on the upper surface 11 and corresponding convex portions on the lower surface 11' the purpose of which will be explained below.

Figure 4:
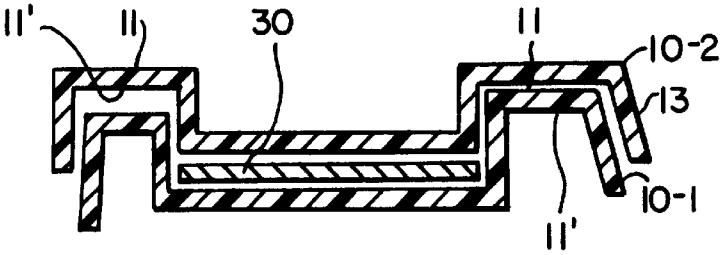
FIG. 4 is a schematic side sectional view of the inventive storing system showing two nestable trays.
Figure 5:
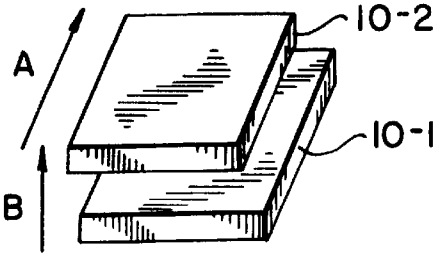
FIG. 5 is a schematic perspective view of the inventive storing system showing two nestable trays.
Figure 6:
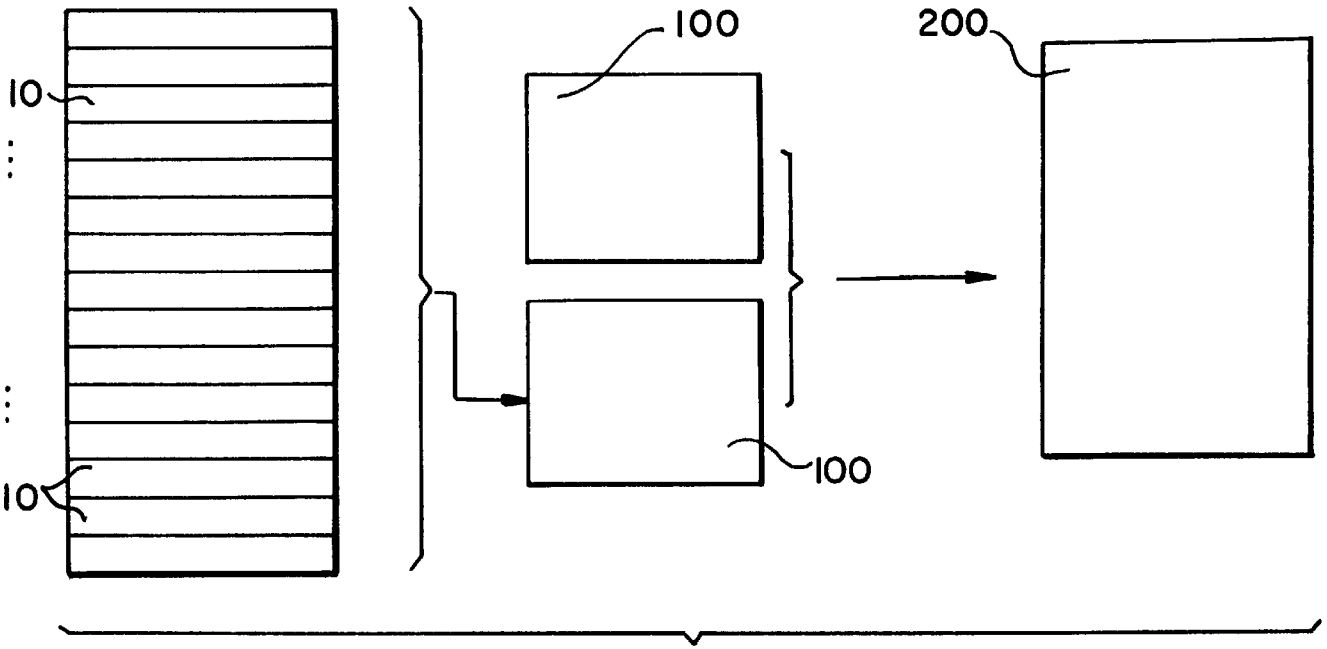
FIG. 6 is a schematic diagram of a preferred embodiment of the inventive storing system of the invention.

Each tray 10 provides the ability to store and ship a plurality of items in a nested fashion on a roughly two-dimensional plane. However, the invention is not so limited as to have nesting merely in one direction, i.e., along the columns in the direction of arrow A of FIG. 1. The inventive trays 10 may be stacked one on top of another so that the trays also nest in a vertical direction, i.e., the direction coming out of the plane of the page of FIG. 1. This is best shown in schematic fashion in FIGS. 4 and 5. In FIGS. 4 and 5, two trays 10-1 and 10-2 are depicted, each having the same configuration as tray 10 in FIGS. 1–3. Because the trays are made as a thin single sheet, any portion that is a convex portion on upper surface 11 is a concave portion on lower surface 11'; conversely, any portion that is a concave portion on upper surface 11 is a convex portion on lower surface 11'. As a result, when one tray 10-2 is placed on top of another tray 10-1, the upper convex portions of tray 10-1 engage and nest with the lower concave portions of tray 10-2. To better insure proper nesting between adjacent trays, each tray is provided with a flared rim 13 which extends from the tray around the perimeter of the tray downward substantially perpendicular from the plane of the tray. Rim 13 is spaced apart from all of the recesses 12 and platforms 16 so that, when one tray 10-2 is placed on top of tray 10-1, rim 13 of tray 10-2 fits over the upper perimeter of tray 10-1. As shown in FIG. 4, even if item or items 30 are disposed on tray 10-1, tray 10-2 will nest atop tray 10-1. To make it easier to separate nested trays, notches 19 are formed in trays 10 to enable a person to obtain a finger purchase on a tray and better separate it from an adjacent nested tray.

In operation, the inventive storage system and method works as follows. Items are placed into sub-recesses 12 of trays 10. Because sub-recesses in the same recesses abut each other, the items placed therein are nested in the direction of arrow A in FIGS. 1 and 5. When a tray 10 is filled with items, another tray is filled and so on. One tray 10-2 may be placed on top of another tray 10-1 so that nesting of the trays occurs in the direction of arrow B as shown in FIG. 5. In this way, two-dimensional nesting occurs, a significant amount of volume is saved, packing efficiency is maximized, and shipping costs are reduced. In one preferred embodiment, shown schematically in FIG. 6, fifteen trays 10 are nested together and packed inside sub-box 100, two of which are packed inside box 200 for storage and shipping. When the items are shipped and unpacked, the now empty trays 10 may be nested before being discarded or recycled, thus reducing the volume of waste generated.

The invention is not limited to the above description but rather is defined by the claims appearing hereinbelow. Modifications to the above description within the ordinary skill in the art are well within the scope of the contemplated invention. For example, while the figures depict the two-dimensional nesting and storage of cutting implements, the invention is contemplated to include the two-dimensional nesting of any items. Moreover, the preferred embodiments of the inventive trays shown depict nesting of objects on a tray in only one direction. However, it is contemplated that the invention includes intra-tray nesting in more than one direction. If the two directions of intra-tray nesting are perpendicular but still within the plane of the tray, then the system provides three-dimensional nesting of objects for an even greater amount of storage and packing efficiency. Also, the embodiments depicted show a tray having five columns and four rows of items. However, any convenient or practical number or arrangement of rows and columns is contemplated as being within the scope of the invention.

What is claimed is:

1. A system for storing implements each having a proximal end with handles and a distal end, the system comprising a plurality of trays, each of said trays further comprising at least one recess, said recess having a plurality of sub-sections, each of said sub-sections abutting an adjacent of said sub-sections, each of said sub-sections having a recess perimeter shaped to conform at least partially to a perimeter of each of the implements, said recess perimeters being formed in an abutting fashion, wherein when the implements are placed in said sub-sections of said recesses, the distal end of each implement will nest at least partially within the proximal handle end of an adjacent implement except for implements disposed on said trays with their respective distal ends near an edge of said trays, the implements thereby being nestably disposable on said trays in a plane, and wherein said trays are nestably stackable in a direction perpendicular to said plane when implements are disposed on said trays.

2. A system for storing implements according to claim 1, wherein said plane is a horizontal plane and said trays are nestingly stackable in a vertical direction.

3. A system for storing implements according to claim 1, each of said sub-sections further comprising a raised ridge disposed within each of said sub-sections, said ridge shaped to conform at least partially to the distal end of one of the implements, wherein when the distal end of a first implement is nested within the proximal end of an adjacent second implement, said raised ridge is interposed between the first and second implements.

4. A system for storing implements according to claim 3, said raised ridges being substantially U-shaped, wherein when an implement is disposed on one of said trays, one of said recess perimeters and one of said raised ridges contact and substantially immobilize the implement.

5. A system for storing implements according to claim 3, wherein said sub-recesses of said trays are adapted to receive the proximal ends of the implements including the handles of the implements.

6. A system for storing implements according to claim 5, wherein said cutting implements include at least one of cuticle nippers and toenail cutters.

7. A system for storing implements according to claim 1, wherein each of said trays comprises a plurality of said recesses formed next to each other on said trays, wherein said sub-recesses of said plurality of recesses are disposed on each of said trays in a two-dimensional array of rows and columns.

8. A system for storing implements according to claim 7, said trays further comprising raised dividers formed between adjacent of said columns of said recesses.

9. A system for storing implements according to claim 8, wherein said raised dividers form substantially convex portions on respective upper surfaces of said trays and substantially concave portions on lower surfaces of said trays.

10. A system for storing implements according to claim 9, wherein said convex portions on a first of said trays are nestingly engageable with said concave portions on a second of said trays.

11. A system for storing implements according to claim 8, further comprising notches formed in said raised dividers adapted to allow access to the implements.

12. A system for storing implements according to claim 1, said trays each further comprising a flared rim formed at least substantially around a perimeter of said tray and extending from a lower surface of said tray in a direction substantially perpendicular to said plane, wherein an upper surface of a first tray is nestable within said flared rim of a second tray.

13. A method of storing cutting implements having handles and cutting blades on opposite ends, comprising the steps of:

providing a plurality of substantially flat trays, each tray having a plurality of recesses, each recess having a plurality of sub-sections each sub-section adapted to receive a cutting implement, each sub-section positioned on the tray so that each cutting implement disposed on the tray nests within an adjacent cutting implement;

arranging a plurality of implements on the plurality of substantially flat trays in a nesting configuration so that the blades of each implement are nested between the handles of an adjacent implement except for implements disposed on the tray with their respective blades near an edge of the tray; and arranging the plurality of substantially flat trays in a nesting configuration so that the upper surface of each tray nests within the lower surface of an adjacent tray.

14. A method according to claim 13, wherein the direction in which the trays nest is substantially perpendicular to the direction in which the cutting implements nest on the trays.

15. A method according to claim 13, wherein the trays are nested in groups of fifteen per sub-box, and sub-boxes are packed two to a box.

16. A method for storing implements according to claim 13, wherein said cutting implements include at least one of cuticle nippers and toenail cutters.

* * * * *